US005538360A

United States Patent [19]

Obermeyer

[11] Patent Number: 5,538,360

[45] Date of Patent: Jul. 23, 1996

[54] CREST GATE OPERATING SYSTEM

[76] Inventor: Henry K. Obermeyer, P.O. Box 668, Fort Collins, Colo. 80522

[21] Appl. No.: 844,825

[22] Filed: Mar. 2, 1992

[51] Int. Cl.[6] ..... E02B 7/20

[52] U.S. Cl. ..... 405/115; 405/91; 405/114

[58] Field of Search ..... 405/87, 92, 91, 405/115, 114, 100, 101, 102, 107, 108; 137/386, 392

[56] References Cited

U.S. PATENT DOCUMENTS

| | | | |
|---|---|---|---|
| 3,338,261 | 8/1967 | Bergeson et al. | 137/386 |
| 3,922,564 | 11/1975 | Kachuk et al. | 137/392 |
| 4,332,507 | 6/1982 | Wakamori et al. | 405/92 |
| 4,498,809 | 2/1985 | Farmer | 405/92 |
| 4,772,157 | 9/1988 | Obermeyer | 405/92 X |
| 4,780,024 | 10/1988 | Obermeyer et al. | 405/115 |

FOREIGN PATENT DOCUMENTS

| | | | |
|---|---|---|---|
| 2460366 | 2/1981 | France | 405/92 |
| 0012410 | 2/1981 | Japan | 405/92 |

*Primary Examiner*—Dennis L. Taylor
*Attorney, Agent, or Firm*—McCormick, Paulding & Huber

[57] ABSTRACT

A crest gate has movable panels controlled in position by inflatable bladders. Air pressure to the bladders or from the bladders is provided to a control system that automatically regulates panel position. Air is bubbled out of a line that is normally below the water level behind the dam and crest gate panels. An actuator assembly is coupled to a valve for selectively venting the bladders. An elastomeric tire is used to create a positioning effect on the valve such that the control system maintains a precise water level. The gate configuration is improved to resist higher loads.

7 Claims, 8 Drawing Sheets

CREST GATE OPERATING SYSTEM

This invention is related to a copending application which is identified by U.S. Pat. No. 5,092,707 issued Mar. 3, 1992. As described in my earlier application automatic water level control systems can be provided for regulating the height of a crest gate dam or inflatable dam solely by reliance upon a source of air under pressure. A bubbler is provided below the surface of the water in the reservoir behind the dam so as to create back pressure to the water level control system which will then regulate the air to the inflatable bladder provided in the crest gate or inflatable dam so as to maintain a predetermined water level or to at least maintain the water level within a predetermined range.

The present invention seeks to provide a system of this general type which can withstand greater loads and which will operate with simpler piping arrangements than those shown and described in my issued U.S. Pat. No. 5,092,707.

Pneumatic crest gates and inflatable dams are preferably provided with an automatic water level control system. Such a control system inflates or deflates air bladders as required in order to maintain a preset upstream water level over a wide range of spillway flow conditions. The systems described in my recently U.S. Pat. No. 5,092,707 and in this application are entirely pneumatic and require no electrical power, so long as a source of air pressure is available. For inflating the air bladders an air source is required such as an air receiver tank at a pressure higher than the required air bladder pressure. Stored power for both raising and lowering the gates in response to water level changes normally comes from the air receiver pressure provided as an element of the source of air pressure. However, even if the air receiver pressure is exhausted the control system may draw a small amount of air from the bladders themselves to operate the bubbler and valve actuator in order to deflate the air bladders as required under high water conditions. Such a system as that described in my U.S. Pat. No. 5,092,707 requires a four way valve or the equivalent and utilizes separate inflation and deflation lines which entail a degree of complication that adds to the expense, and may increase the maintenance requirements for such a system.

The present disclosure seeks to avoid the necessity for such a four way valve and utilizes a unique actuator assembly for operating either a simple vent valve in combination with a blower control means or a three way valve or the equivalent in conjunction with an air source control air pressure in the bladders.

A sophisticated water level control system as shown in detail in my U.S. Pat. No. 5,092,707. This application incorporates by reference the disclosure in said U.S. Pat. No. 5,092,707.

SUMMARY OF THE INVENTION

This invention then relates to an inflation control system for one or more inflatable bladders provided in a crest gate dam or inflatable dam which is designed to hold the water level behind the dam to a predetermined level H and also relates to the means of restraining the gates from traveling too far and to the means of accommodating higher gate loads than the prior art.

The invention in its presently preferred form normally relies upon a source of air under pressure together with conduit means connecting this air pressure source to the bladders. A valve positioner is provided for venting the conduit means by moving the valve element from CLOSED to DEFLATE or vice versa.

A novel actuator assembly is coupled to the vent valve element and this actuator assembly includes a pneumatic actuator which may take the form of a bicycle tire for example and the said tire has an inflation port which is connected to an air bubbler line that is also connected at its opposite end to a submerged bubbler port located at a position below the predetermined level H of the water behind the dam.

The actuator assembly preferably includes a plenum chamber defined by plates, one plate being secured to one side of the pneumatic tire inner bead and the other plate to the opposite or outer bead so as to define a plenum chamber therebetween, which plenum chamber is also defined in part by the annular space defined by the tire itself.

Means is provided for connecting the air pressure source to the bubbler air line inflating the tire and pressurizing the plenum chamber. Since the tire is of toroidal geometry, the hoop tension of the tire at compressed positions tends to provide a component of force on the actuator so as to move the actuator assembly and hence the valve element from a position which will fill the system, toward a position so that the system will be vented.

In short, the force component provided by the pressurized rubber tire adds or subtracts from the force exerted by the air pressure on the upper plate defining the plenum chamber. This upper plate defines a diaphragm for the actuate assembly.

As pressure in the tire increases, on the .other hand, this upper plenum plate will be displaced by air pressure to the point where the tire is expanded to a position such that the force provided by the hoop tension in the tire itself will tend to subtract from the force exerted by the air pressure on the upper plenum plate or diaphragm.

The foregoing system provides a positioning effect on the movable element of the control valve. The resulting operation of this valve by the novel actuator assembly of the present invention allows the low bubbler pressure to directly control the bladder air supply without the necessity for a more complex system utilizing electrical water level detection, solenoid valves and float type detectors.

DETAILED DESCRIPTION

Turning to the drawings in greater detail, and referring initially to the disclosure in U.S. Pat. No. 5,092,707 issued Mar. 3, 1992 to the applicant herein, a crest gate operating system generally includes inflatable bladders provided on the downstream side of pivotal panels to provide a crest gate at a dam spillway in order to control the height of the water behind the crest gate. The bladder is generally inflated from a source of air pressure so as to maintain a predetermined water level behind the dam.

In accordance with the disclosure of said patent at least one generally rectangular rigid gate panel is provided with parallel and horizontal first and second marginal edges. Means is provided for pivotally supporting each panel for movement on the lower marginal edge at the crest of the dam spillway. The inflatable bladders are provided downstream of the panel or panels and between the dam spillway and the panels. Each bladder is secured to the panel supporting means and in accordance with the said patent is provided for selective inflation or deflation. A source of air under pressure together with inflation and deflation lines operate under the control of a four way valve for selectively adding or venting air to the inflation and deflation lines respectively. Means is also provided for venting air at low pressure at a predetermined point in the water upstream of the gate system such that the back pressure exerted on the low pressure air by the water itself will vary in proportion to the waters depth in the upstream pool. Transducer means is provided for operating the control valve means in response to these air pressure changes by a unique pneumatic circuit.

Figure 1:
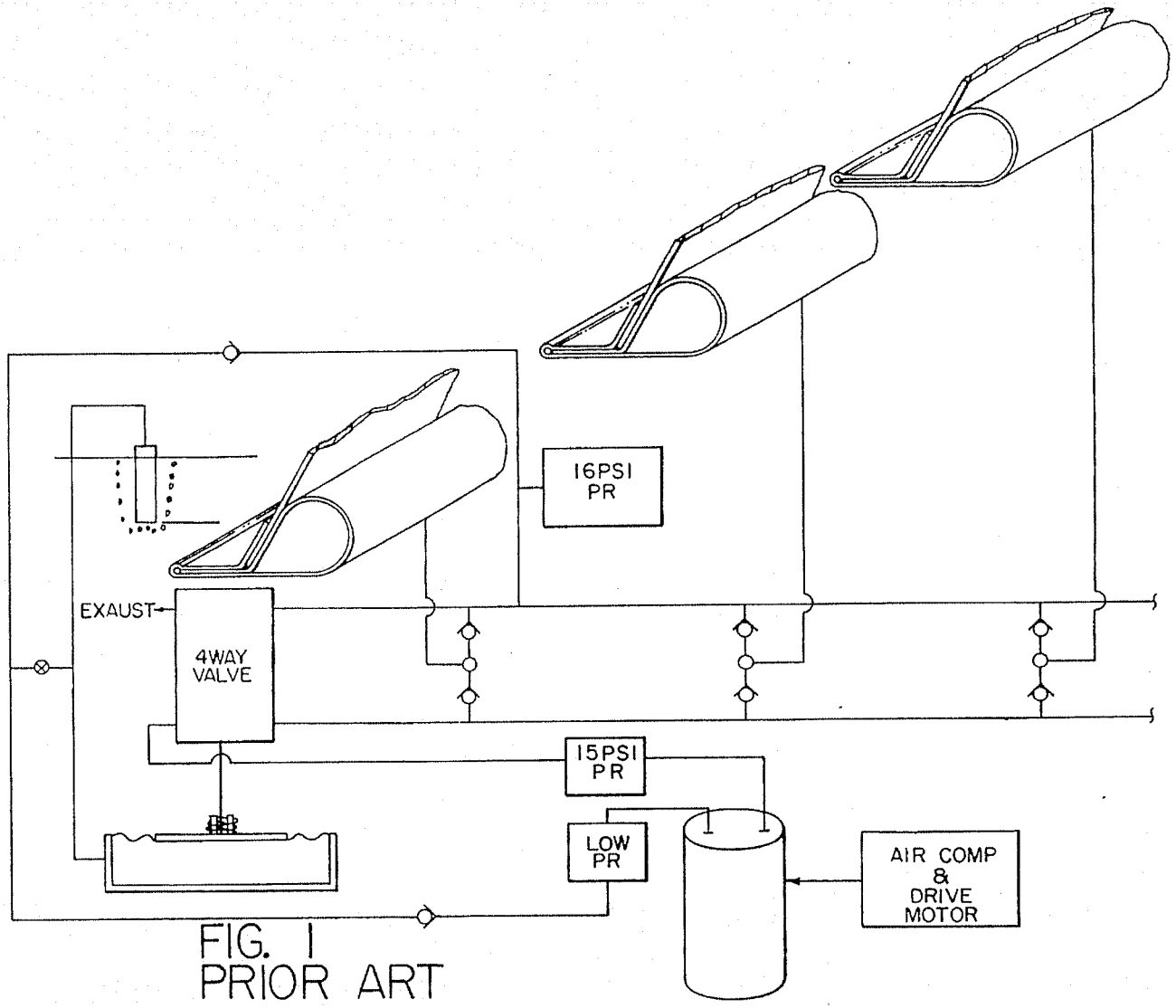
FIG. 1 PRIOR ART
FIG. 1 is an overall view of the control system as described in my above mentioned U.S. Pat. No. 5,092,707.
Figure 2:
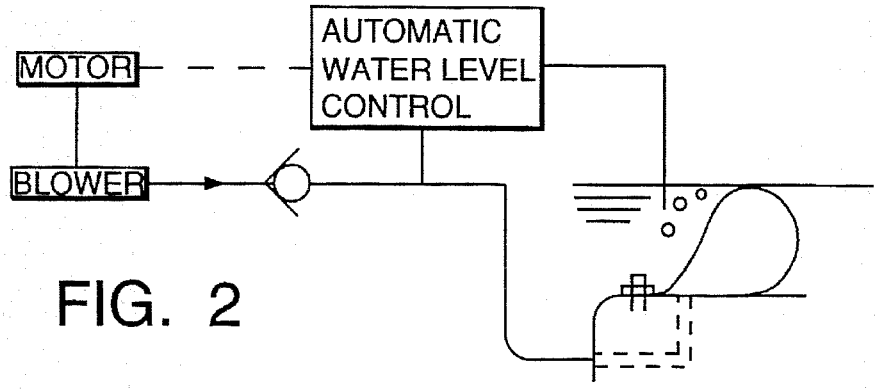
FIG. 2 shows a similar control system in conjunction with an inflatable dam.

The present invention seeks to operate a system using a single line to any one bladder or group of bladders for inflation and deflation. More specifically, a single vent valve of two position configuration or a three way valve or the equivalent is operated by an actuator assembly in order to accomplish substantially all of the advantages set out in the above-identified patent in a system of much less complexity and hence lower cost and of more universal application. The vent valve may be used in coordination with a blower control means to allow both inflation and deflation control. FIG. 2 shows such a system.

The present invention provides for the higher loads incurred with larger scale (higher) crest gate systems. Because of the fact that the operating stresses generally increase in direct proportion to system height if the geometry is unchanged, it is desirable to utilize the improvements in gate system geometry embodied in the present invention in order to maintain acceptable loads and stresses in higher systems. These improvements include a bladder clamping arrangement, a stronger panel stop bracket, a hinge retainer capable of sustaining higher loads and a gate panel restraining sheet which evenly distributes the restraining loads and protects the bladders from damage.

Figure 3:
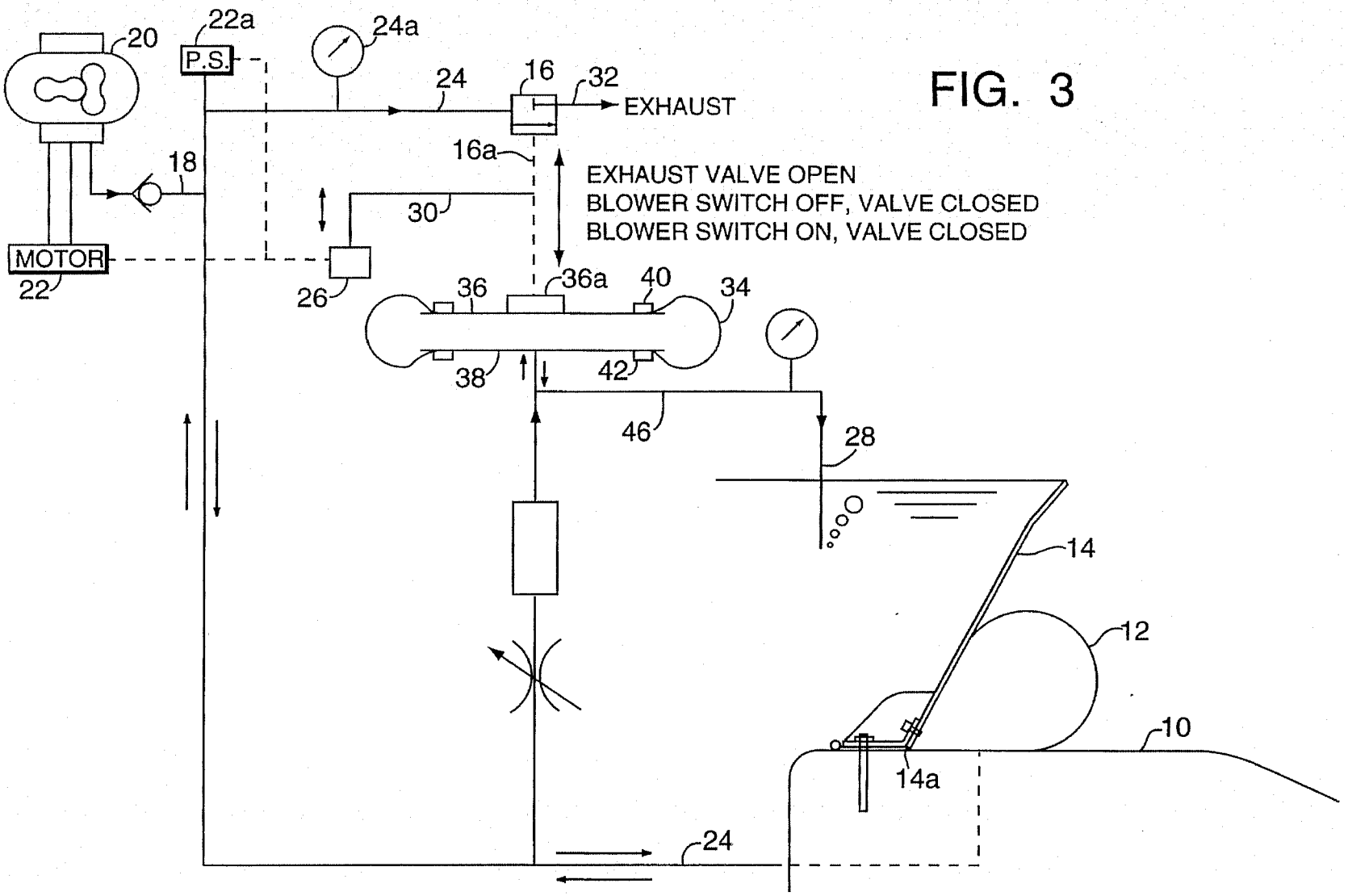
FIG. 3 is a schematic view illustrating a system constructed in accordance with the present invention and including a single two way vent valve coupled with an actuator assembly in accordance with the present invention.

Referring specifically to FIG. 3 the dam spillway is indicated generally at 10, and has a bladder 12 provided downstream of panel 14, the latter being pivotally supported at its lower edge as indicated generally at 14*a*. Air is provided to the bladder under the control of a three way valve 16 from a source of air under pressure in the form of air delivery line 18 and an air compressor or blower 20. The blower or compressor will provide air pressure to the system as called for by the pressure switch 22*a* and inflation switch 26 provided that the motor 22 has a source of energy usually electrical, but possibly from other energy sources. The pressure switch 22*a* may be provided in the inflation/deflation line 24 which services the bladder 12, which pressure switch 22*a* can be set so as to shut down the motor 22 by any suitable means as suggested in FIG. 3.

The electrical inflation switch 26 is provided in the path of movement of the valve actuator 16*a* such that a reduction of air pressure in the bubbler line indicated generally at 28 causes the arm 30 of an actuator assembly, to be described, to close the switch 26 and energize the motor causing the blower or compressor 20 to increase the bladder pressure until the water level rises to the desired height. In the event that air pressure provided in line 18 increases excessively, the actuator assembly will cause the arm 30 to move upwardly from the switch, opening the vent valve and releasing the excessive air to the exhaust line 32.

It should be noted that although air is the usually preferred medium for operation of such gate systems and inflatable dams, certain situations may dictate the use of a gas such as nitrogen or a liquid such as water. This disclosure is intended to allow interchangeability between fluid mediums.

Turning next to a more detailed description of the actuator assembly itself, FIG. 3 illustrates the actuator assembly as comprising a conventional pneumatic tire 34 which has movable and stationary plates 36 and 38 clamped to opposing beads of the tire 34 as indicated generally at 40 and 42. Air at pressures in the line 24 is available to feed bubbler manifold 46 and to inflate the space defined between the plates 36 and 38 and the space defined by the annular interior of the tire 34. This line 44 is itself connected to the air bubbler 28 by the bubbler manifold 46. Finally, a weight of desired dimension 36*a*, a spring, or other position restoring means is placed to act upon the movable plate 36 so as to achieve a desired characteristics of movement of the arm structure 30 and movable valve element 16*a* provided on the upper plate 36 as shown.

The above described actuator assembly operates, at very low air pressure inside the pneumatic tire, so as to exert a generally upward force that tends to overcome the weight of the upper plate 36 and any weight thereon, reducing the air pressure at which the arm 30 will contact the switch 26, energizing the motor 22 and turning on the blower 20. In the event that the pneumatic tire is only partially inflated a sideways force will have no effect on the weight of the moveable plate 36 or on any added weight provided on the plate 36. Finally, as a result of excessive air pressure within the pneumatic tire the force exerted will be in an opposite direction as that provided by the weight of the upper plate 36 and any weight thereon.

Figure 4:
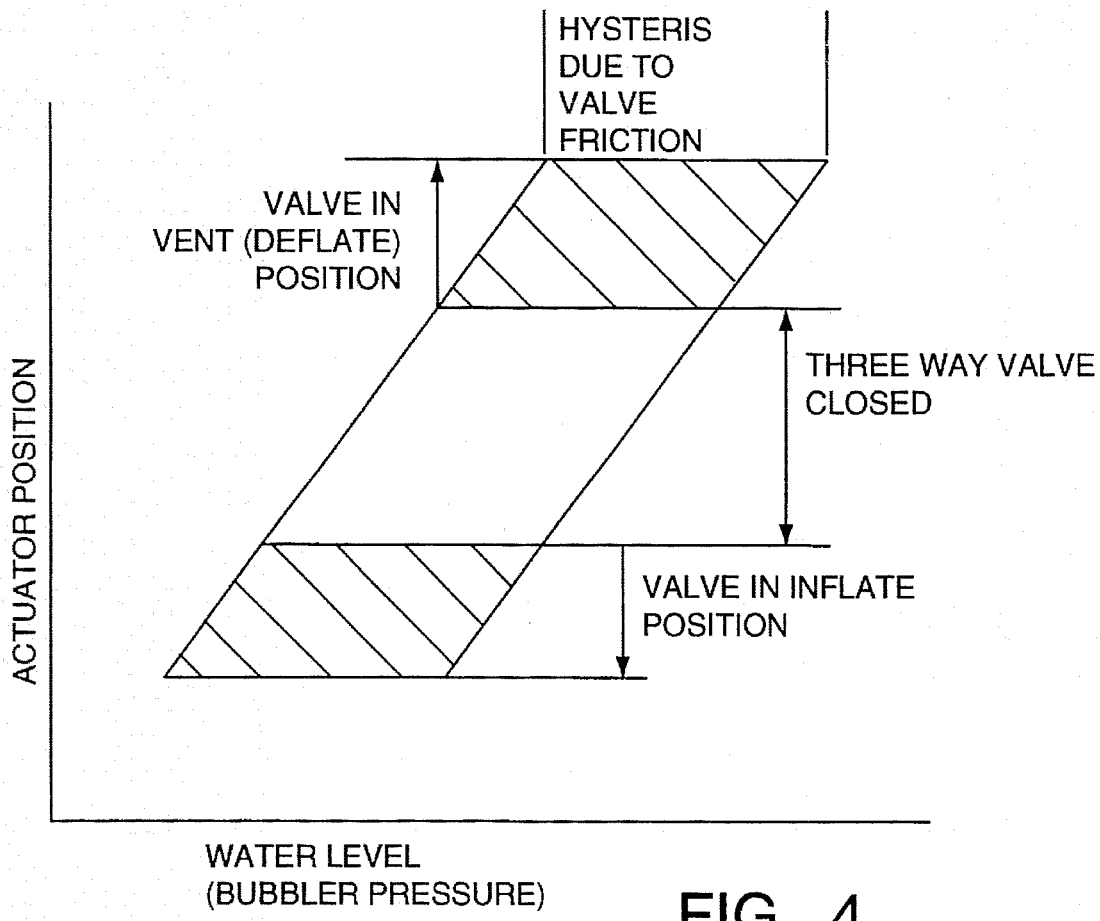
FIG. 4 illustrates the relationship between bubbler pressure and actuator position in the case of the actuator acting upon a 3 way valve.
Figure 5:
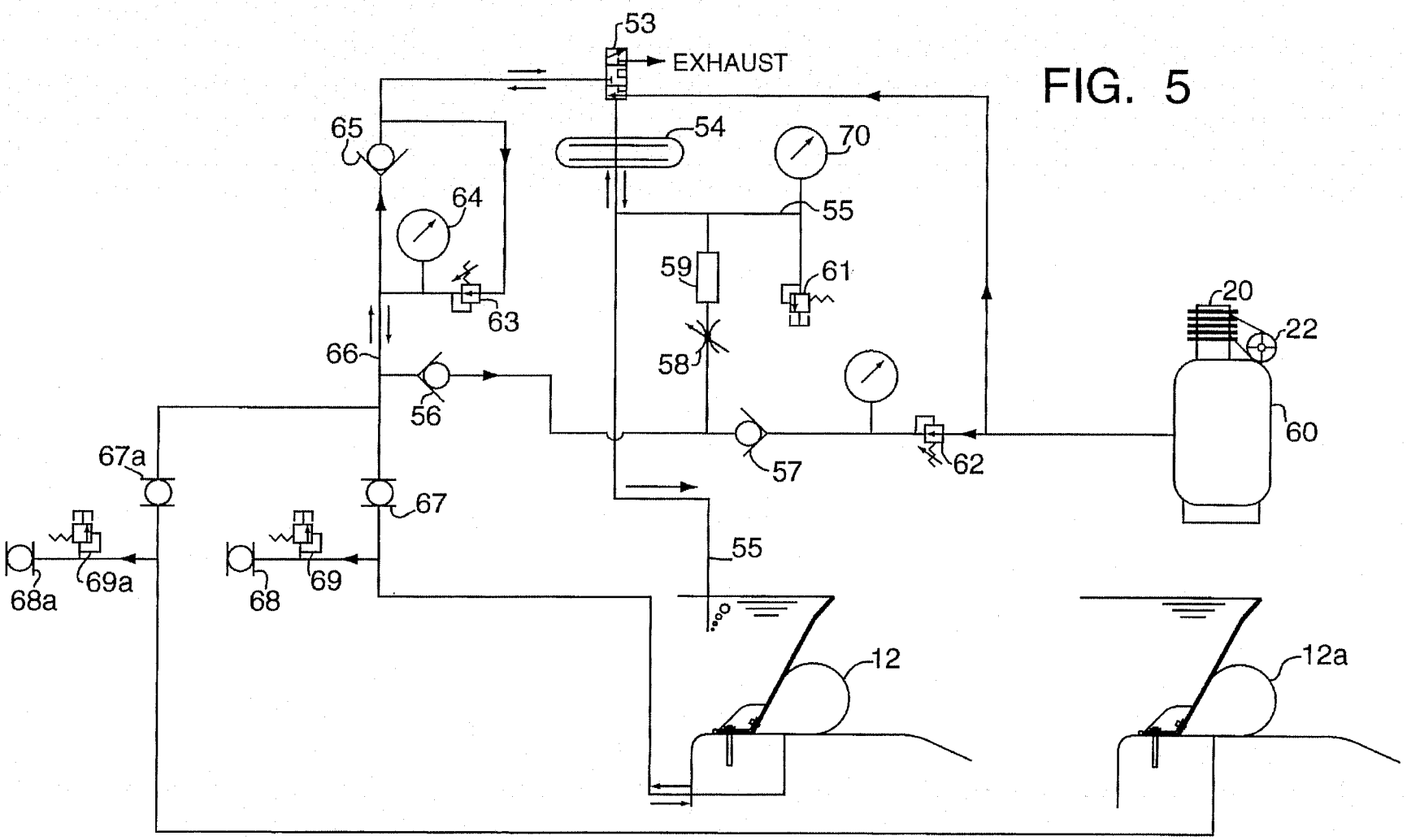
FIG. 5 is a schematic view of a system constructed in accordance with the present invention and including a 3 way valve actuated directly by the bubbler system.

FIG. 4 illustrates the relationship between bubbler pressure and actuator position in an aspect of this invention as shown in FIG. 5 wherein inflation and deflation of the air bladder(s) is controlled by a three way valve 53 controlled by valve actuator 54 which is connected to the bubbler manifold 55. Air is supplied through check valve 56 or through check valve 57 to a flow control valve 58 which controls flow to the bubbler manifold 55 through flow meter 59. The extremely large size of the actuator 54 could cause said actuator to develop destructively large forces if inadvertently pressurized to the pressure of air bladders 12 or 12*a* or the air receiver 60. Pressure relief valve 61 protects the actuator 54 from dangerously high pressures. Relieving pressure regulator 62 reduces the air receiver 60 pressure to a pressure similar to the pressure in bladder 12 so that a single flow control valve 58 setting is appropriate whether the air is supplied through check valve 56 or check valve 57. Pressure gage 70 allows the operator to read bubbler manifold 55 pressure and to verify proper operation of valve actuator 54. Relieving pressure regulator 63 reduces the pressure of air supplied from the air receiver 60 to a pressure suitable for bladders 12 and 12*a*. The relieving pressure regulator 63 is preferably located as shown downstream of the three way valve to allow accurate pressure regulation to the air bladders 12 and 12*a* regardless of the flow dependent pressure drop across three way valve 53. Pressure gage 64 facilitates adjustment of relieving pressure regulator 63. Check valve 65 permits the three way valve to directly vent the bladder manifold 66 while preventing high pressure air from the air receiver 60 from entering the bladder manifold 66. Valves 67 and 67*a* allow manual isolation of bladders 12 and 12*a* respectively. Valves 68 and 68*a* allow manual deflation of the bladders 12 and 12*a* respectively. Pressure relief valves 69 and 69*a* provide over pressure protection for the bladders 12 and 12*a* respectively.

Figure 6A:
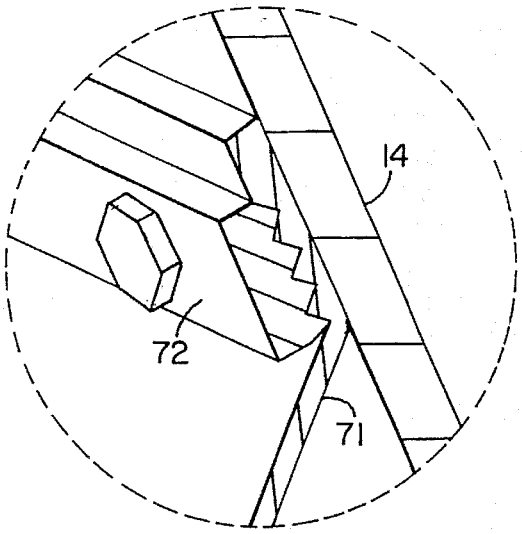
FIG. 6A is a detail of the area designated 6A in FIG. 6.
Figure 6:
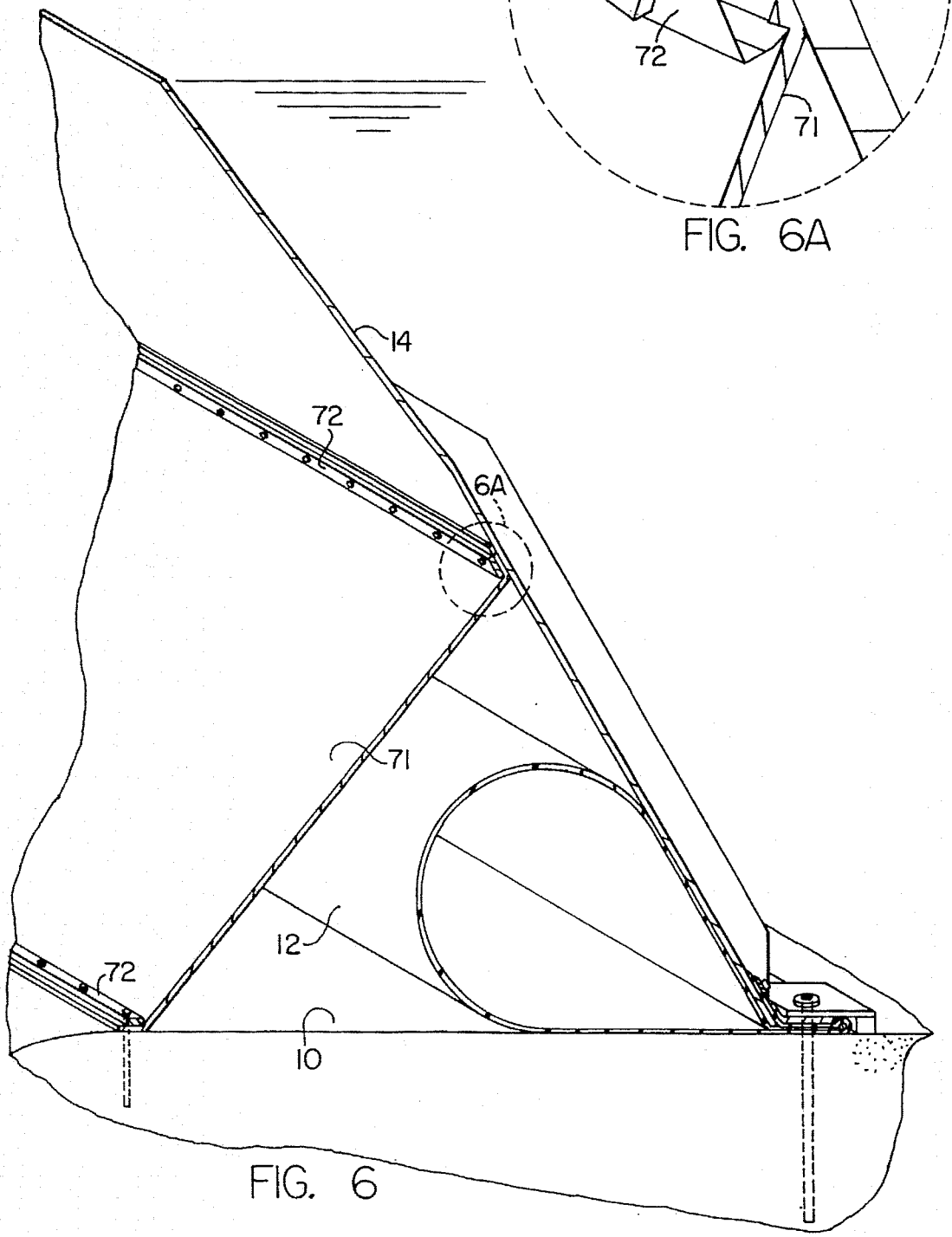
FIG. 6 illustrates a continuous flexible member acting to limit the extent of upstream gate travel.

FIG. 6 illustrates a flexible sheet 71 attached to the gate panel 14 and to the spillway 10 which sheet prevents the gate panel 14 from pivoting too far upstream under low water conditions. Retaining clamps 72 attach the sheet to the gate panel 14 and spillway 10.

Figure 7:
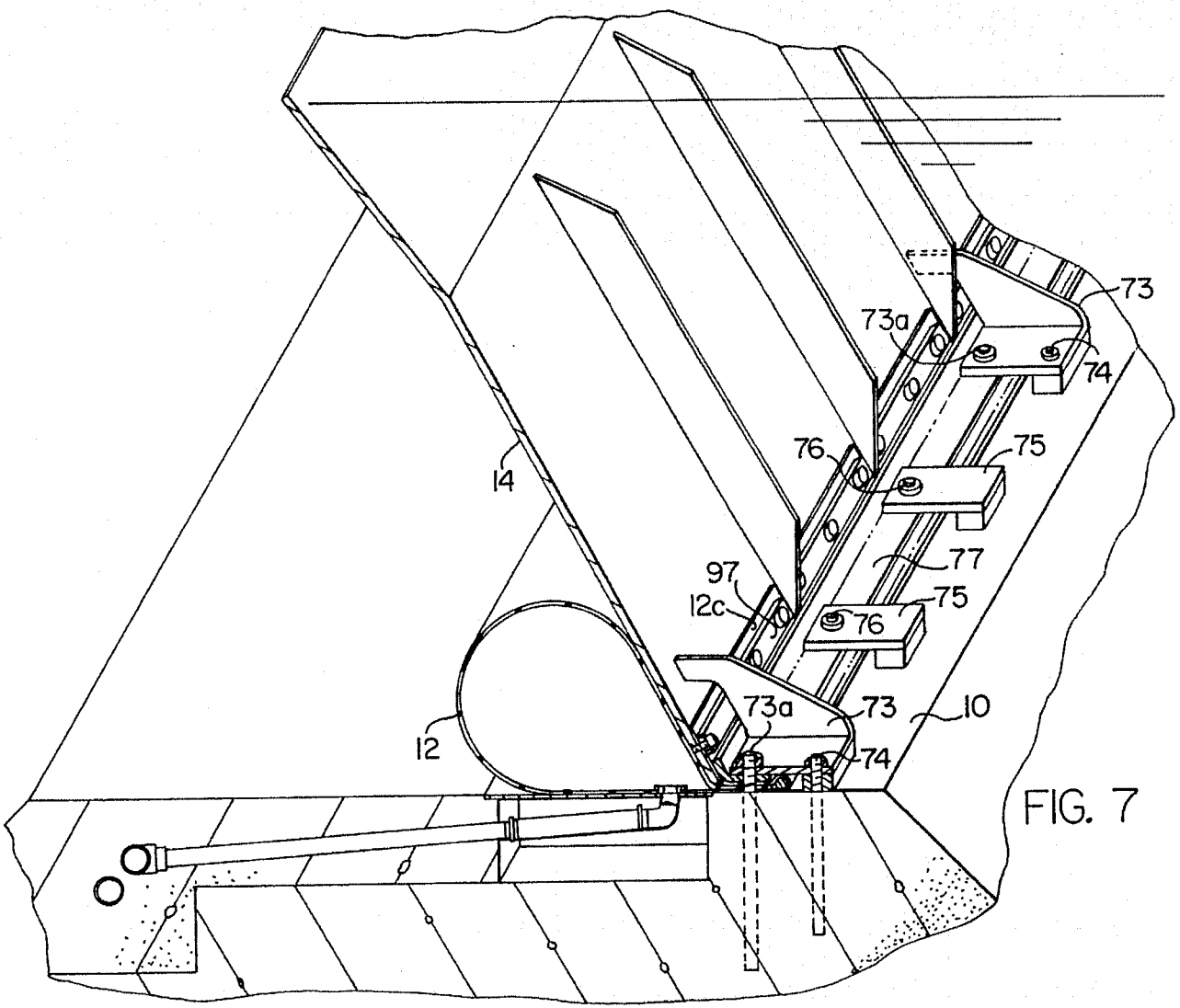
FIG. 7 illustrates clamps and restraining brackets used to allow damming of higher water levels while keeping anchor bolt loads within allowable limits.

FIG. 7 illustrates stop brackets 73 for limiting the upstream excursion of gate panel 14. The stop brackets 73 are configured to transmit a downward reaction to the spillway, rather than through, the clamped rubber bladder 12 as disclosed in my U.S. Pat. No. 5,092,707 when subjected to upward gate panel 14 loads. The brackets 73 and anchor bolts 73*a* keep the clamp bar 77 tightly clamped against the bladder assembly 12 despite the upward reaction of the gate panel 14 loads transmitted through the hinge flap 12*c* of the bladder 12 to the brackets 73. The stop brackets may also be separately anchored to the spillway with anchors 74. FIG. 7 also illustrates clamps 75 which transmit loads to the spillway 10 and are held in place by anchor bolts 76.

Figure 8:
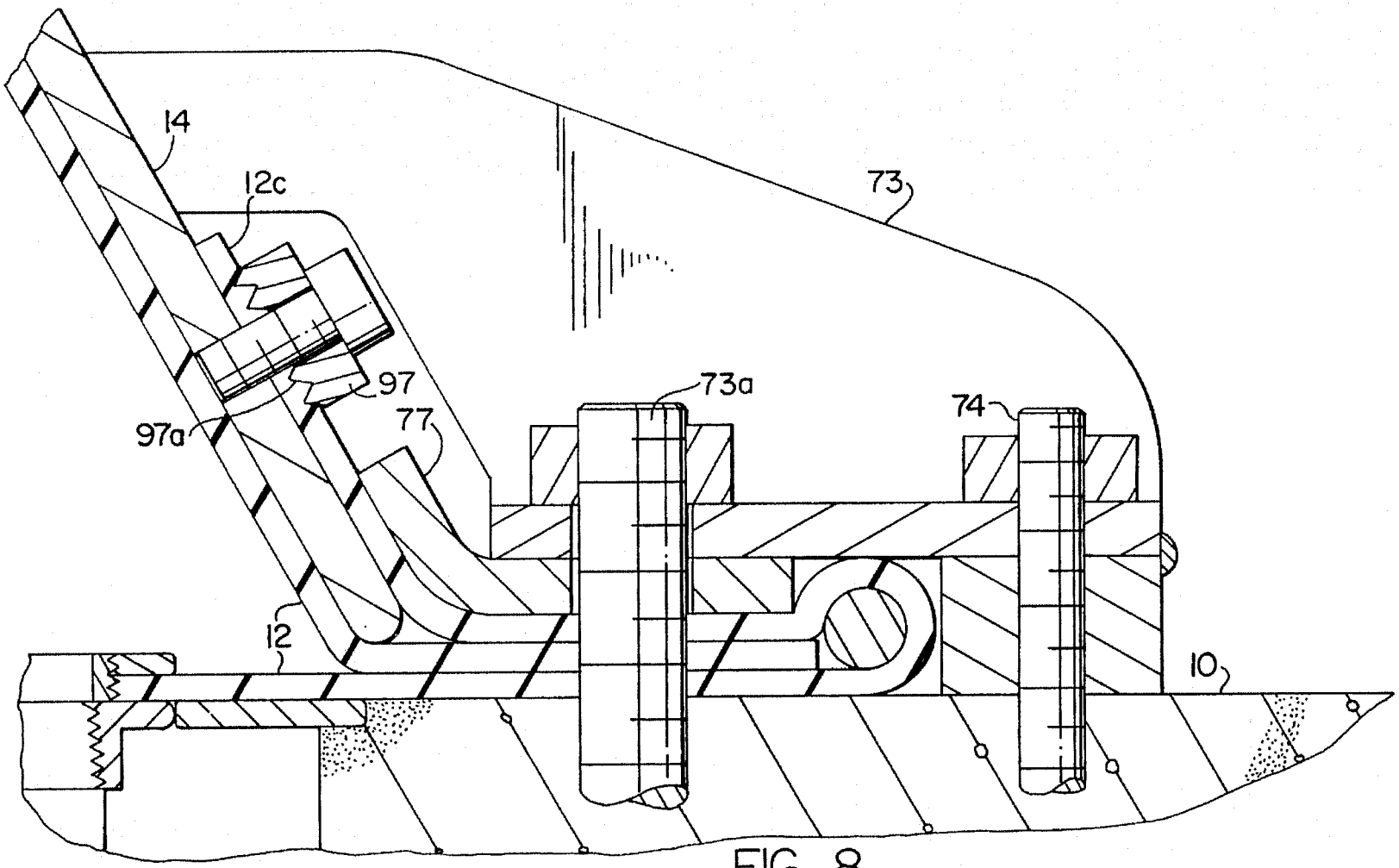
FIG. 8 illustrates in cross section the restraining bracket shown in FIG. 7 and a special serrated hinge retainer which allows damming higher water levels.

FIG. 8 illustrates in cross section the details of the restraining bracket 73 which is also shown in FIG. 7. FIG. 8 also illustrates the hinge retainer 97 with serrations 97*a*. These features allow the crest gate system as a whole to be constructed to greater heights and to withstand the greater loads associated with greater heights. It should be noted that for a fixed geometry the stresses in all components increase in direct proportion to system height. The geometry changes disclosed in this application function to reduce operating stresses in comparison to those disclosed in my copending application and in the prior art.

Figure 9A:
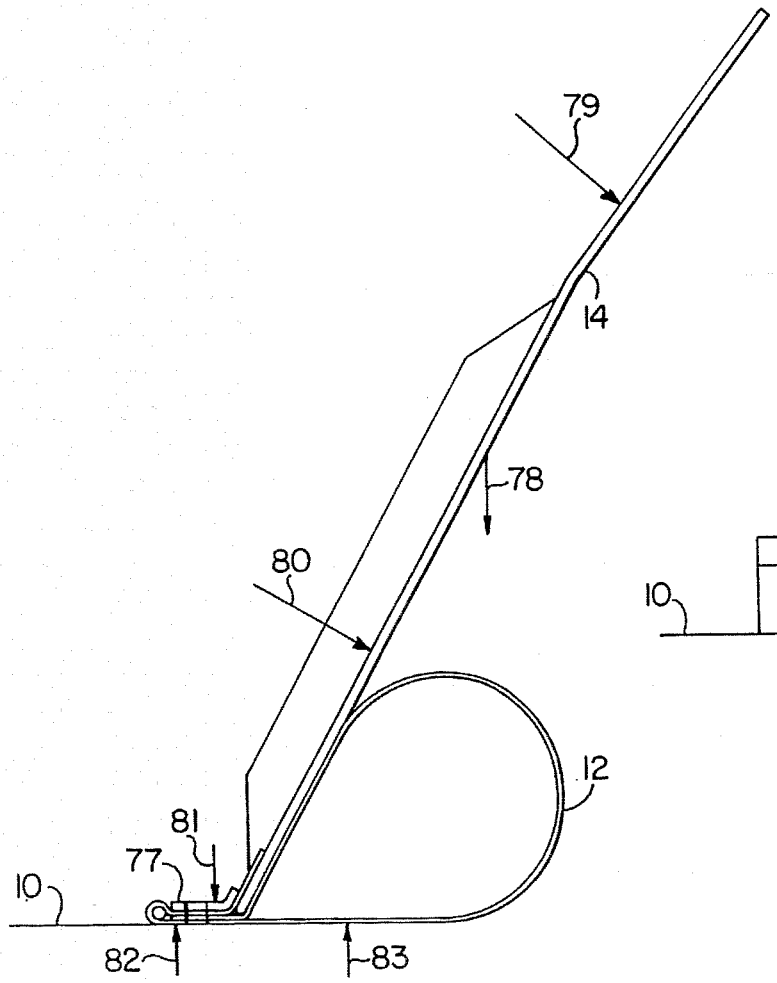
FIGS. 9*a* and 9*b* illustrate the loads on the gate system under high water operating conditions.
Figure 9B:
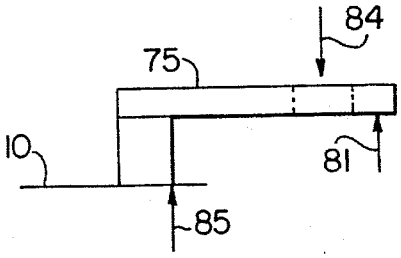

FIG. 9*a* illustrates a free body diagram of bladder 12, gate panel 14 and clamp bar 77 acting as an assembly and shows the relative positions of weight 78 of gate 14, hydrostatic force 79 on the upper portion of gate 14, hydrostatic force 80 on the lower portion of gate 14, force 81 due to clamp 75, force 82 due to clamping bladder against spillway 10, and the force 83 due to air bladder 12 acting against spillway 10. FIG. 9*b* illustrates the corresponding free body diagram of clamp 75. The reactive clamping force 81*a* (opposite force 81 of FIG. 9*a*) is resisted by force 84 of anchor bolt 76 (not shown). The resulting moment is resisted by force 85 from spillway 10.

Figure 10A:
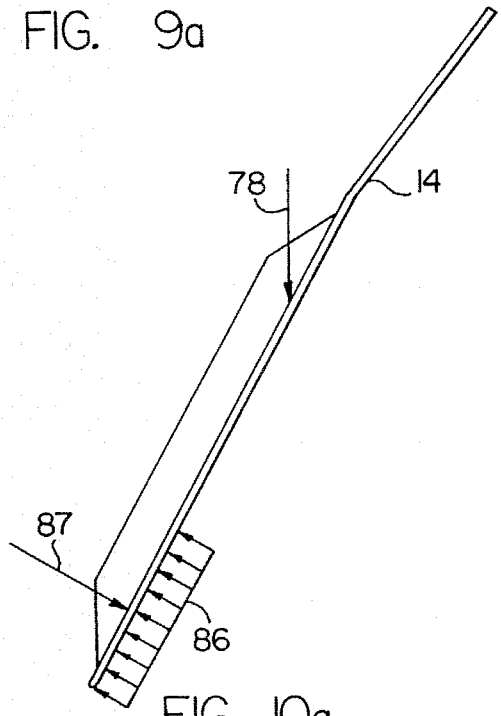
FIGS. 10*a* and 10*b* illustrate the loads on the gate system under low water conditions.
Figure 10B:
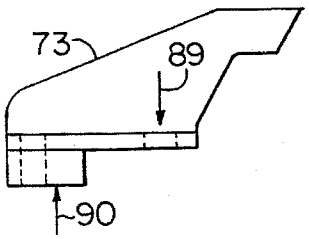

FIGS. 10*a* and 10*b* illustrate the load conditions on gate panel 14 and stop bracket 73 with bladder 12 under normal operating pressure but without any water loads. Under this condition gate panels 14 would flip over and end up upstream of spillway 10 if it were not for a restraining means such as stop brackets 73.

I claim:

1. An inflation control system for at least one inflatable bladder in a crest gate dam that is designed to maintain a predetermined water level behind the dam, said system comprising:

a source of fluid under pressure, conduit means connecting said fluid pressure source to the bladder, a vent valve for venting said conduit means, said vent valve having a removable element, an actuator assembly coupled to said vent valve element, said actuator assembly including at least one movable element, an inflation port for said actuator assembly, and a gas bubbler provided to generate a predetermined back pressure that is proportional to the actual water level behind the crest gate dam, a submerged gas bubbler line and said inflation port connected to said submerged bubbler line, whereby gas is continuously bubbled out of said bubbler port at the end of said line to generate back pressure that is related to the actual water level behind the crest gate dam.

2. The combination according to claim 1 wherein said actuator assembly includes a horizontally arranged pneumatic tire having upper and lower beads, plates provided between said upper and lower beads of said pneumatic tire and defining a plenum chamber therebetween, means connecting said fluid pressure source to said submerged gas bubbler line for inflating said tire and pressurizing said plenum chamber, said tire being of elastomeric material so that inherent resiliency of the tire at lower pressure tends to provide a component of force urging said vent valve to off.

3. The combination according to claim 2 wherein said tire at high pressure tends to provide a component of force in a direction opposite that provided at said lower tire pressure.

4. The combination according to claim 3, wherein said actuator assembly further includes biasing means for urging said plates toward one another to thereby increase the pressure of the fluid in said plenum chamber defined by said tire and said plates.

5. The combination according to claim 2 wherein said gas bubbler line is in communication with the plenum chamber defined by said actuator assembly.

6. The combination according to claim 1 wherein said gas bubbler line is selectively connected to the fluid pressure of said bladders, said fluid comprising air, and the air pressure of said bladders thereby operating said gas bubbler continue to generate back pressure related to the actual water level behind the damn in the event of loss of fluid under pressure at said source.

7. The combination according to claim 1 further characterized by a three-way valve for controlling fluid flow in conduit means communicating with said bladders, said conduit means comprising a single line to each bladder capable of delivering fluid under pressure to the bladder or for venting said bladder.

* * * * *